US007318257B2

(12) United States Patent
Offa-Jones

(10) Patent No.: US 7,318,257 B2
(45) Date of Patent: Jan. 15, 2008

(54) RECLOSABLE FASTENERS FOR PLASTICS BAGS AND OTHER CONTAINERS

(75) Inventor: Martin John Charles Offa-Jones, North Yorkshire (GB)

(73) Assignee: Illinois Tool Works, Inc., Glenville, IL (US)

( * ) Notice: Subject to any disclaimer, the term of this patent is extended or adjusted under 35 U.S.C. 154(b) by 0 days.

(21) Appl. No.: 10/070,467

(22) PCT Filed: Jul. 5, 2001

(86) PCT No.: PCT/GB01/02971

§ 371 (c)(1),
(2), (4) Date: Jul. 11, 2002

(87) PCT Pub. No.: WO02/04298

PCT Pub. Date: Jan. 17, 2002

(65) Prior Publication Data

US 2002/0170156 A1 Nov. 21, 2002

(30) Foreign Application Priority Data

Jul. 11, 2000 (GB) ..... 0016894.8

(51) Int. Cl.
*B65D 33/24* (2006.01)

(52) U.S. Cl. ..... 24/585.12

(58) Field of Classification Search ..... 24/30.5 R, 24/399, 400, 585.11, 585.12, 304, 693, DIG. 39, 24/DIG. 40, DIG. 50, 30.5 P, 427; 383/63–65, 383/68, 69, 61.2, 61.3; 156/66; 53/139.2, 53/412, 133.4; 493/213, 214
See application file for complete search history.

(56) References Cited

U.S. PATENT DOCUMENTS 2,780,261 A 2/1957 Svec et al. ..... 150/3
2,797,463 A * 7/1957 Dorman et al. ..... 24/399
3,173,184 A 3/1965 Ausnit ..... 24/201
3,325,084 A * 6/1967 Ausnit ..... 229/77
4,655,862 A 4/1987 Christoff et al. ..... 156/66
4,673,383 A * 6/1987 Bentsen ..... 493/381
4,733,778 A * 3/1988 Boeckmann et al. ..... 206/714
4,817,188 A 3/1989 Van Erden ..... 383/63
4,964,739 A * 10/1990 Branson et al. ..... 383/5
5,192,135 A * 3/1993 Woods et al. ..... 383/63
5,216,787 A * 6/1993 Custer et al. ..... 24/585.12
5,462,360 A * 10/1995 Tilman et al. ..... 383/63
5,573,614 A * 11/1996 Tilman et al. ..... 156/66
5,577,305 A * 11/1996 Johnson ..... 24/585.12
5,628,566 A 5/1997 Schreiter ..... 383/63

(Continued)

FOREIGN PATENT DOCUMENTS

EP 1 033 317 A2 9/2000

(Continued)

*Primary Examiner*—James R Brittain
(74) *Attorney, Agent, or Firm*—Woodcock Washburn LLP

(57) ABSTRACT

A zipper (10) for application to a film or web using cross-web techniques comprises two interengageable elements (12, 14), each having engageable hooks (20, 22), and each having an upstanding post (24) at the margin of the fastener which is engageable with a heel (28) at the opposing margin of the other element, with the respective posts (24) and heels (28) being complementarily angled (26) at their respective contact surfaces. This enables the closure more easily to resist pressure without distortion.

7 Claims, 1 Drawing Sheet

U.S. PATENT DOCUMENTS 5,774,955 A * 7/1998 Borchardt et al. ..... 24/584.1
6,004,032 A * 12/1999 Kapperman et al. ..... 383/5
6,026,761 A * 2/2000 Parniske et al. ..... 114/343
6,047,450 A 4/2000 Machacek et al. ..... 24/399
6,167,597 B1 * 1/2001 Malin ..... 24/585.1

FOREIGN PATENT DOCUMENTS

GB 1145325 3/1969
GB 2 250 057 A 5/1992
GB 2 267 933 A 12/1993
JP 04294747 A * 10/1992

* cited by examiner

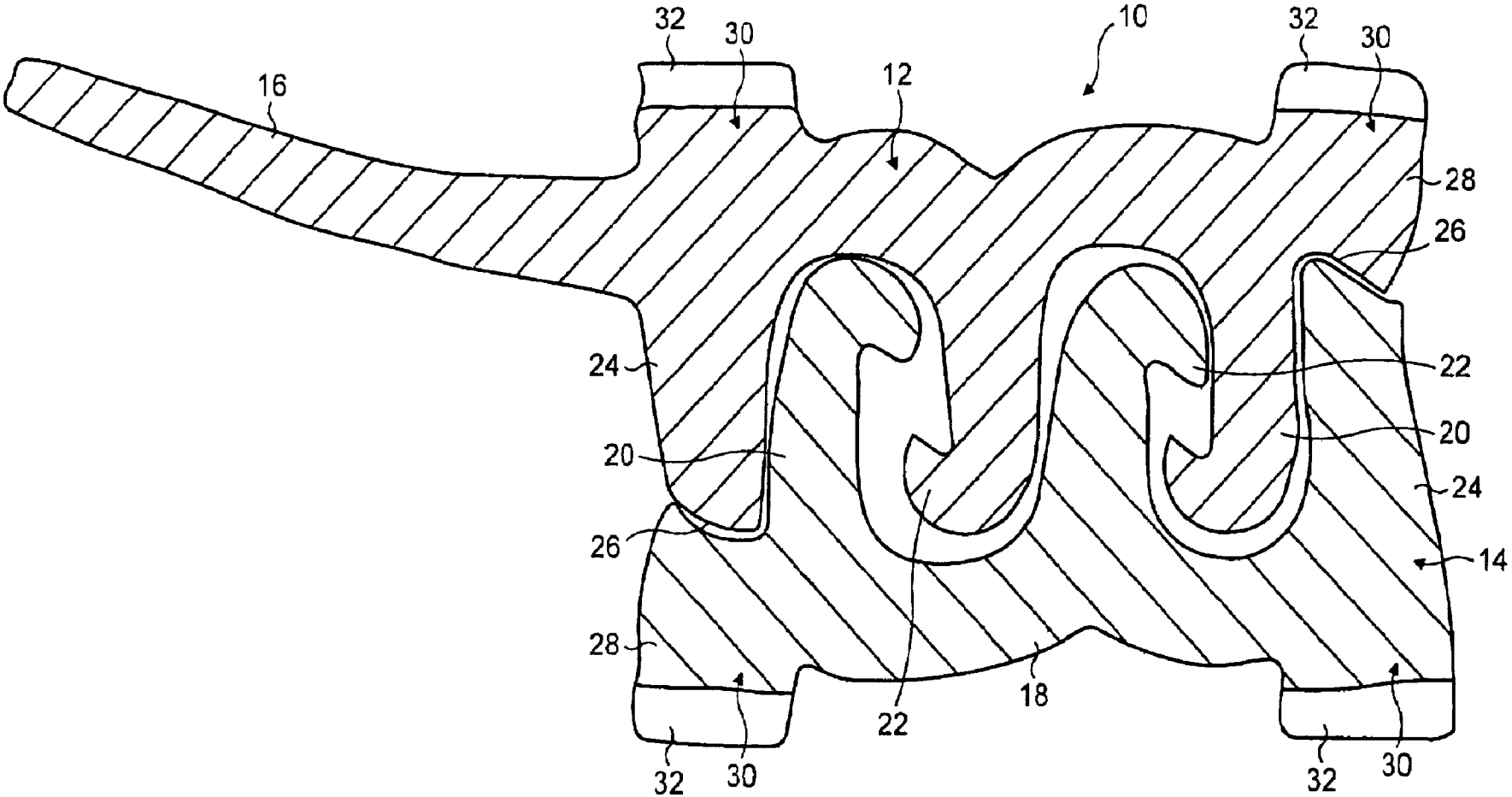
10
12
14
16
18
20
22
24
26
28
30
32

RECLOSABLE FASTENERS FOR PLASTICS BAGS AND OTHER CONTAINERS

FIELD OF THE INVENTION

This invention relates to reclosable fasteners, otherwise known as zippers, for plastics bags and other containers, and is particularly concerned with zippers intended to be applied to a film or web using cross-web techniques.

BACKGROUND TO THE INVENTION

When a zipper strip is applied to a film or web, heat and pressure are applied to effect the welding of the zipper to the film or web. The heat and/or the pressure can result in damage to the closure. Various measures have been adopted to try to minimise the effects of the heat and pressure. However, it can still happen that the zipper is damaged or distorted as a result of these external influences.

SUMMARY OF THE INVENTION

It is an object of the present invention to provide an improved design of zipper which is resistant to distortion or damage due to the welding heat and/or pressure.

In accordance with the present invention there is provided a reclosable fastener for plastics bags and other containers, comprising two elements, each element comprising at least one portion releasably engageable with a portion of the other element, and each element comprising an upstanding post at the margin of the fastener which is engageable with a heel of the other element at the opposing margin of said other element, wherein the respective posts and heels of the two elements are complementarily angled at their respective contact surfaces.

The fact that the respective contact surfaces of the posts and heels are angled or mitred enables the closure more easily to resist pressure without distortion and without the hooks being squashed. The margins of the closure are more easily able to resist bending and to maintain their desired supporting function.

The releasably engageable portions are preferably hooked portions.

Preferably, each of the elements of the closure is provided with two hooks, engageable with the hooks of the other element.

In a preferred embodiment of the invention, and with a view particularly to resisting distortion or damage due to heat, each of the elements is provided at or adjacent to its margins, on the face remote from the hook or hooks, with a pair of protruding ribs which provide additional bulk at these marginal zones. The ribs are preferably overlaid each with a layer of high performance sealing/welding material, such as EVA for example.

In a preferred embodiment of the invention, a single long flange is provided on one only of the two interengageable elements of the closure, this flange being arranged to face the inside of the bag and being used for initial attachment to the film or web.

BRIEF DESCRIPTION OF THE DRAWINGS

In order that the invention may be more fully understood, one presently preferred embodiment of zipper in accordance with the invention will now be described by way of example and with reference to the accompanying drawing which is a schematic cross-sectional view through the zipper.

DESCRIPTION OF THE PREFERRED EMBODIMENT

Referring to the drawing, there is shown a zipper, indicated generally at 10, comprising a first element 12 and a second element 14. The two elements 12 and 14 are generally the same as each other, apart from the fact that element 12 is provided with a single elongate flange 16. Each element 12, 14 comprises a body portion 18 with two upstanding legs 20 which terminate in hooks 22. The respective hooks 22 of the two elements 12 and 14 are interengageable to make the reclosable fastener.

Each element 12, 14 also comprises an upstanding support post 24 at one margin. The support post 24 is slightly longer than the hooked legs 20, 22 so that it extends slightly beyond the tops of the legs. The upper end surface 26 of each post 24 is tapered to provide an angled contact surface. Facing each support post 24, on the opposing element, there is provided a heel portion 28, again at the margin. The surface of each heel portion 28 facing the respective post 24 is shaped, i.e. angled, to be complementary to the angled contact surface 26. As can be seen from the drawing, with this arrangement, the respective posts and heels nest with one another to provide a shape-locking configuration which tends to resist squashing or outward bending under vertical loads. The angled contact surfaces are able to absorb the welding pressure and maintain their linear integrity, thus preventing the hooked legs 20, 22 from being squashed or distorted.

In order to reduce the effects of the welding heat, each of the closure elements 12 and 14 is provided with a pair of ribs 30 on the outside face remoter from the legs 20. The respective ribs 30 are provided again at the margins of the closure, in alignment with the posts 24 and heel portions 28. The ribs 30 are provided by a thickening of the material of which each of the two elements is composed. Because of the additional bulk provided by the ribs 30, they also contribute to the resistance of the closure to deformation due to pressure. On each rib 30 there is provided a layer 32 of a material which is a high-performance sealing/welding material or blend of materials, such as ethylene vinyl acetate (EVA) for example. This facilitates the welding of the zipper to the encompassing web or film (not shown). The layers 32 are co-extruded with the closure elements 12 and 14.

The single long flange 16 which is part of element 12 is arranged to face the inside of the bag or container. This flange is used for initial attachment to the film or web as the zipper is applied to the web by a cross-web technique. The provision of a single long flange provides increased internal strength to the bag by altering the angle at which the load in the bag acts against the zipper closure.

The invention claimed is:

1. A reclosable fastener for plastics bags and other containers, comprising:

a first element comprising a first elongate body portion, at least one first upstanding elongate profiled member extending away from the first body portion, a first upstanding post at a first lateral margin of the first body portion, and a first heel at a second lateral margin of the first body portion; and a second element comprising a second elongate body portion, at least one second upstanding elongate profiled member extending away form the second body portion, a second upstanding post at a first lateral margin of the second body portion, and a second heel at a second lateral margin of the second body portion;

wherein the first and second posts each comprise an upper end surface providing an angled contact surface;

wherein the first and second profiled members are releasably engagable when the first and second elements are pressed together with the first and second profiled members facing each other in order to produce an engaged condition of the first and second elements; and wherein, in the engaged condition, the first post and the second heel are aligned and are arranged to contact each other only at a first pair of complementarily angled contact surfaces, one contact surface of the first pair of contact surfaces being the upper end surface of the first post and the other contact surface of the first pair of contact surfaces being a complementarily-angled end surface of the second heel, and further, in the engaged condition, the second post and the first heel are aligned and are arranged to contact each other only at a second pair of complementarily angled contact surfaces, one contact surface of the second pair of contact surfaces being the upper end surface of the second post and the other contact surface of the second pair of contact surfaces being a complementarily-angled end surface of the first heel;

wherein, in the engaged condition, the first upstanding post extends from the first body portion across a median plane of separation lying between the first and second body portions to the second heel so that said first pair of contact surfaces make said contact with each other entirely to one side of said plane and the second upstanding post extends from the second body portion across said median plane of separation so that said second pair of contact surfaces make said contact with each other entirely to the other side of said plane, wherein, in the engaged condition, the first and the second pairs of contact surfaces lie entirely to respective opposite sides of said median plane of separation, the contact surfaces being angled relative to the median plane and offset therefrom in respective opposite directions perpendicular thereto; and wherein, in the engaged condition, the first and second posts and the first and second heels form a configuration which provides resistance to compression forces exerted on the first and second elements in their engaged condition thereby substantially preventing distortion of the first and second profiled members under application of a load urging the first and second elements together and towards the median plane when in their engaged condition.

2. The reclosable fastener as claimed in claim 1, in which both the first and second upstanding profiled members further comprise hooks.

3. The reclosable fastener as claimed in claim 2, in which the first and second elements each comprise two elongate profiled members comprising hooks, with the hooks of the first profiled members being engageable with the hooks of the second profiled member.

4. The reclosable fastener as claimed in claim 1, in which the first element further comprises a first pair of protruding ribs on a face of the first body portion opposite the first profiled member, a first rib of the first pair being in alignment with the first upstanding post and a second rib of the first pair being in alignment with the first heel; and the second element further comprises a second pair of protruding ribs on a face of the second body portion opposite the second profiled member, a first rib of the second pair being in alignment with the second upstanding post and a second rib of the second pair being in alignment with the second heel.

5. The reclosable fastener as claimed in claim 4, in which each of the ribs is overlaid with a layer of sealing/welding material.

6. The reclosable fastener as claimed in claim 5, in which the sealing/welding material comprises ethylene vinyl acetate.

7. The reclosable fastener as claimed in claim 1, further comprising a single flange provided on only one of the first and second elements, for attachment to a film or web.

* * * * *